US005450052A

United States Patent [19]

Goldberg et al.

[11] Patent Number: 5,450,052

[45] Date of Patent: Sep. 12, 1995

[54] MAGNETICALLY VARIABLE INDUCTOR FOR HIGH POWER AUDIO AND RADIO FREQUENCY APPLICATIONS

[75] Inventors: Ira B. Goldberg; Jane H. Hanamoto; Charles S. Hollingsworth, all of Thousand Oaks; Ted M. McKinney, Riverside, all of Calif.

[73] Assignee: Rockwell International Corp., Seal Beach, Calif.

[21] Appl. No.: 169,083

[22] Filed: Dec. 17, 1993

[51] Int. Cl.[6] ..... H01F 15/02; H01F 21/08

[52] U.S. Cl. ..... 336/83; 336/84 C; 336/155; 336/174; 336/212

[58] Field of Search ..... 336/84 R, 84 C, 84 M, 336/83, 174, 175, 155, 212

[56] References Cited

U.S. PATENT DOCUMENTS

| | | | |
|---|---|---|---|
| 1,287,982 | 12/1918 | Hartley | 336/155 |
| 2,811,652 | 10/1957 | Lipkin | 336/174 |
| 2,888,637 | 5/1959 | Lipkin | 336/155 |
| 2,897,294 | 7/1959 | Lipkin | 336/155 |
| 2,916,696 | 12/1959 | Schonstedt | 336/174 |
| 2,946,030 | 7/1960 | Slade | 336/155 |
| 2,970,224 | 1/1961 | Lipkin et al. | 336/174 |
| 3,343,074 | 9/1967 | Brock | 336/155 |
| 3,413,485 | 11/1968 | Oshima | 336/174 |
| 3,505,588 | 4/1970 | Brock | 336/155 |
| 3,509,498 | 4/1970 | De Chanteloup | 336/155 |
| 4,030,057 | 6/1977 | Kohler et al. | 336/84 C |
| 4,320,337 | 3/1982 | Hartmann et al. | 336/174 |

*Primary Examiner*—Thomas J. Kozma

*Attorney, Agent, or Firm*—Gregory G. Williams; M. Lee Murrah; George A. Montanye

[57] ABSTRACT

A magnetically variable inductor for high power, high frequency applications which includes a solenoid with a magnetic core therein, disposed coaxially around a conductor for carrying the high power, high frequency signal and a variable current source coupled with the solenoid so that a manipulation of the current through the solenoid results in a variable inductance for said conductor. Also disclosed are additional features of ferrite rings disposed around each end of the magnetic core, a shield disposed between the core and the solenoid, and a sheath disposed around the solenoid.

1 Claim, 1 Drawing Sheet

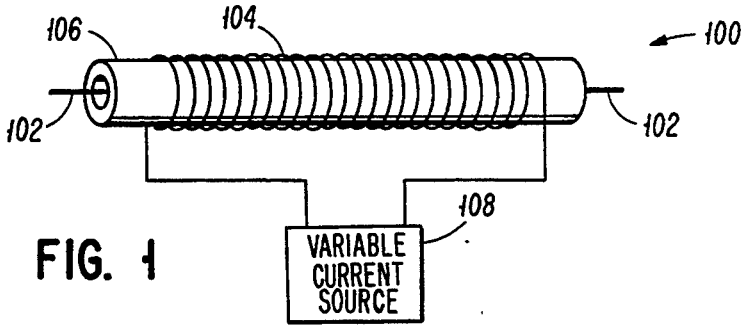
FIG. 1
FIG. 2
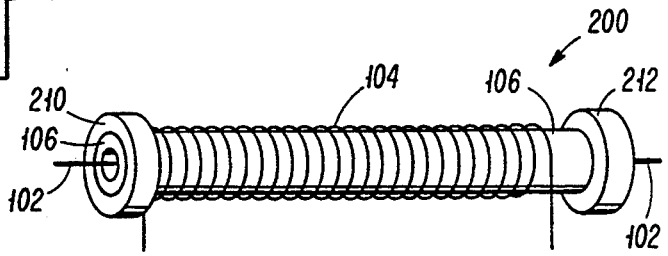
FIG. 3
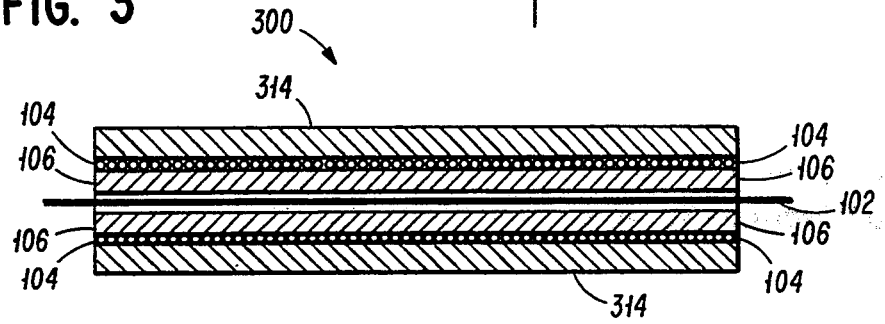
FIG. 4
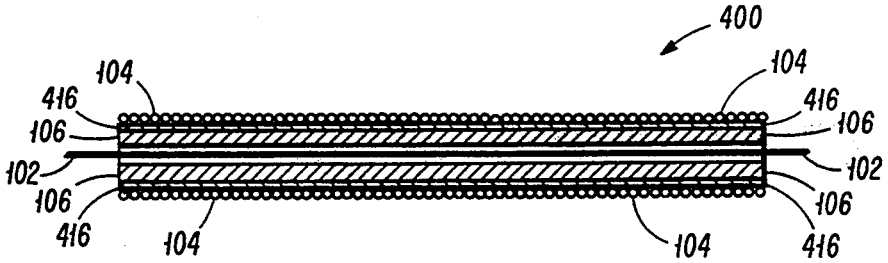
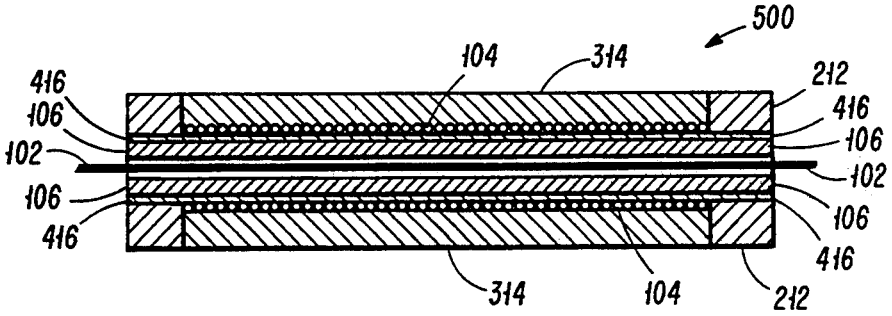
FIG. 5

MAGNETICALLY VARIABLE INDUCTOR FOR HIGH POWER AUDIO AND RADIO FREQUENCY APPLICATIONS

FIELD OF THE INVENTION

The present invention generally relates to inductors, and more particularly concerns inductors for high power audio and radio frequency systems, and even more particularly concerns magnetically variable inductors for high power audio and radio frequency applications.

BACKGROUND OF THE INVENTION

Variable inductors are commonly needed in high power, high frequency applications. In the past, variable inductors have been provided in high power, high frequency applications by both mechanically and electrically or magnetically controlled systems.

One typical mechanically controlled variable inductor system has been to use an array of fixed air core solenoids that are switched in and out of a circuit as needed. In such cases, the element with the smallest inductance is typically connected to the circuit by a mechanical contact that can slide along the solenoid; so that, continuous values of inductance can be obtained.

Typical electrically or magnetically controlled variable inductor systems can be constructed with external magnets. One example which is used in a device called a paraformer is described in I. M. Gottlieb, *Regulated Power Supplies* 4ed., published by Tab Books, Blue Ridge Summit, Pa., 1992, on p.199–205. In this example, one horseshoe-shaped electromagnet (primary) is placed along the axis of a second electromagnet (secondary). However, the poles are rotated by a quarter-circle from each other. In this configuration, an adjustable electrical current through the primary, controls the permeability of the second magnet. This arrangement reduces, but does not eliminate the pickup between the secondary and primary coils. However, because of the size and number of turns required in the secondary, such a configuration is frequently unsuitable for high frequency operation. Another example is given in U.S. Pat. No. 2,882,392, issued to W. F. Sands on Apr. 14, 1959, in which varying the inductance value of a ferrite core inductor is accomplished by mechanically moving the core in and out of a coil through which an electrical current is passed. However, mutual inductance or pick up between the ferrite inductor and the external coil causes a significant loss of power through the inductor, particularly at high frequencies. The tuning speed is also limited by the mechanical movement of the coil or the core.

While these mechanical and electrical or magnetic systems have been used in the past, they do have several serious drawbacks. A major drawback with the mechanical system is that the switching time can be quite long. In some circumstances it can be on the order of several seconds, depending on the precision of the set inductance. Secondly, the mechanical contacts can wear and become unreliable after extended use or use in adverse environments. Thirdly, the large number of inductors necessary to cover the required inductance range often make the system relatively large and expensive.

With the electrically or magnetically controlled variable inductors, the control circuits are often adversely affected by having the high frequency signal induced on the control circuit. This often arises when the magnetic field, caused by the RF signal, and the controlled magnetic field are parallel. Secondly, the electric or magnetic systems are often subject to high signal loss, unless it is minimized by a typically complex and expensive circuitry. Such additional circuitry can contribute to increased size and expense, loss of high frequency power, and causes heating of the adjacent electrical components.

Consequently, there exists a need for improvement in variable inductor systems for high power, high frequency applications which do not have the long switching time, the unreliability and signal loss, or complex and expensive control circuitry which are associated with typical prior art systems.

SUMMARY OF THE INVENTION

It is an object of the present invention to provide a variable high power, high frequency inductor.

It is a feature of the present invention to utilize a solenoid with a magnetic core therein, disposed coaxially about the high power, high frequency signal line.

It is an advantage of the present invention to provide a fast switching variable inductor.

It is another advantage of the present invention to provide a variable inductor with enhanced reliability.

It is yet another advantage of the present invention to provide a variable inductor with low signal loss in a relatively simple and inexpensive implementation.

It is still another advantage of the present invention to reduce the signal induction from the high power, high frequency signal unto the control circuitry.

The present invention provides a magnetically variable inductor which is designed to satisfy the aforementioned needs, produce the earlier propounded objects, include the above described features and achieve the already articulated advantages. The invention is carried out in a "mechanical contact-less" system in the sense that the sliding mechanical contact or switch, of the prior art, is not used. Instead, inductance is controlled by a magnetic field resulting from a variable current through the coaxial solenoid. Additionally, the invention is carried out in a "complex and expensive control circuit-less" system in the sense that the expensive and complex circuitry typically needed to minimize power loss and RF signal induction, in a typical electrical or magnetically controlled inductor, is eliminated. Instead, the present invention utilizes a control mechanism that induces a magnetic field perpendicular to the magnetic field induced by the RF signal.

Accordingly, the present invention includes a magnetically variable inductor including a conductor for carrying high power, high frequency signals; and a solenoid with a magnetic core therein, disposed coaxially about the conductor; so that, a manipulation of the current through the solenoid results in a variable magnetic field, and thereby variable inductance.

BRIEF DESCRIPTION OF THE DRAWINGS

The invention may be more fully understood by reading the following description of an embodiment of the invention in conjunction with the Figures wherein;

FIG. 1 is a perspective view of a preferred embodiment, of the present invention, showing the solenoid having a magnetic core therein disposed coaxially about the high power RF conductor;

FIG. 2 is a perspective view of a variable inductor, of the present invention, which includes ferrite rings disposed over each end of the magnetic core.

FIG. 3 is a cross sectional representation of a variable inductor, of the present invention, which includes a low frequency ferrite sheath disposed over the solenoid.

FIG. 4 is a cross sectional representation of a magnetically variable inductor, of the present invention, which includes a non magnetic electrically conductive shield disposed between the solenoid and the magnetic core.

FIG. 5 is a cross sectional representation of a magnetically variable inductor, of the present invention, which includes the low frequency ferrite rings disposed over the ends of the magnetic core, the sheath disposed over the solenoid, and the shield disposed between the solenoid and magnetic core.

DETAILED DESCRIPTION

Now referring to the drawings, where like numerals refer to like matter and text throughout. More particularly referring to FIG. 1, there is shown a magnetically variable inductor, of the present invention, generally designated 100, having a conductor 102 extending therethrough. Disposed in a coaxial configuration about conductor 102 is solenoid 104. Disposed in the center of solenoid 104, in a coaxial relationship, is magnetic core 106. Coupled to solenoid 104 is variable current source 108.

In a preferred embodiment, the conductor 102 is designed to carry a high power, high frequency signal thereon. The diameter of the conductor 102 can be increased for RF circuit elements with higher currents. The solenoid 104 is preferably a conducting wire wound into a helical coil. The magnetic core is preferably a low loss ferrite that may be individually selected for specific applications. Typically a Nickel-Zinc; Manganese-Zinc-, or low coercivity hexagonal ferrite would be used, but other magnetically soft materials could also be used. The choice of material for the magnetic core is a matter of designer's choice depending on the specific application and performance desired. When the conductor 102 carries an extremely high current, it is preferable to leave a gap between the magnetic core 106 and the conductor 102; so that, the core 106 responds linearly to the RF waveform.

The configuration shown in FIG. 1 has two advantages. First, the magnetic flux generated by the current in conductor 102 is circumferential in the ferrite. Because the flux forms a complete loop, the permeability is not limited by demagnetization as would be the case if gaps were present or if an open core were used. Second, the magnetic flux density is small because conductor 102 acts as a solenoid with only ½ turn. This reduces the magnetic losses due to the ferrite material. If capacitive coupling between the conductor 102 and the solenoid 104 becomes a problem at high frequencies, the thickness of the core 106 and or the diameter of the solenoid 104 can be increased. Under such circumstances the current through solenoid 104 may need to be increased to provide the desired level of magnetization.

In operation, a high power RF signal on line 102 is presented to a magnetically variable inductor by providing a variable control current from current source 108 through solenoid 104. The current through solenoid 104 generates a magnetic field which is perpendicular to the magnetic field induced by the oscillating current through conductor 102. A variation in the control current results in a variable inductance.

Now referring to FIG. 2, there is shown a perspective view of a preferred embodiment, of the present invention, generally designated 200, showing the magnetically variable inductor 100 of FIG. 1 which includes additional rings 210 and 212 disposed over each end of the magnetic core 106. Preferably, rings 210 and 212 are ferrite rings. The selection of the ring material is not critical, but it is expected that better results will be obtained if the DC permeability of the ring is greater than the magnetic core 106. It is also preferred that the ring be placed over the magnetic core 106 because low frequency ferrites are conductive and can dissipate the RF energy. The rings 210 and 212 are included to increase the magnetic field generated by the solenoid. Increasing the magnetic field is important because it can increase the dynamic range of the inductor.

Now referring to FIG. 3, there is shown a cross sectional representation of a magnetically variable inductor, of the present invention, generally designated 300, which is similar to the inductor 100 of FIG. 1, but which additionally includes a low frequency ferrite sheath 314 placed over the solenoid 104. The ferrite sheath 314 acts as a flux return path in a similar manner to the ferrite rings 210 and 212 of FIG. 2. Similarly, selection of the ferrite is not critical but best results are expected with materials of relatively high DC permeability.

Now referring to FIG. 4, there is shown a cross sectional representation of a variable inductor, of the present invention, generally designated 400, which is similar to the variable inductor 100 of FIG. 1 except that it includes an additional shield 416 between the magnetic core 106 and the solenoid 104. It is believed that the shield will prevent power loss by stray radiation. Additionally, as the frequency of the ferrite in the magnetic core increases and the permeability decreases, the shield will contain the RF field and increase the effectiveness of the inductor 400. Preferably, the shield 416 is a non magnetic electrically conductive material.

Now referring to FIG. 5, there is shown a cross sectional representation of a magnetically variable inductor, of the present invention, generally designated 500, which is similar to the variable inductor 100 of FIG. 1 except that it includes the rings 210 and 212 of FIG. 2, the sheath 314 of FIG. 3, and the shield 416 of FIG. 4.

Throughout the description references are made to audio and radio frequencies, these are intended as examples only. Any appropriate signal may be used with varying results. The detailed frequencies are a matter of design choice for a particular application.

It is thought that the magnetically variable inductor, of the present invention, and many of its attendant advantages will be understood from the foregoing description and it will be apparent that various changes in the form, construction, and arrangement of the art thereof may be made without departing from the spirit and scope of the invention or sacrificing all of its material advantages. The forms herein before described being merely preferred or exemplary embodiments thereof.

We claim:

1. A variable inductor comprising:

a first conductor, oriented in a first direction, for carrying an AC signal, and thereby generating a first magnetic field;

a solenoid for generating a second magnetic field disposed coaxially about said first conductor, so that there is no direct physical connection between the solenoid and the first conductor;

a magnetic core disposed within said solenoid which is coaxially disposed about said first conductor;

a variable control current source coupled with said solenoid for generating the variable second magnetic field;

a first ferrite ring disposed around an end of said magnetic core;

a ferrite sheath disposed about said solenoid; and, a conductive shield disposed around said core and within said solenoid.

* * * * *